United States Patent [19]

Lintott et al.

[11] Patent Number: 4,590,910

[45] Date of Patent: May 27, 1986

[54] LIQUID FUEL INJECTION PUMPING APPARATUS

[75] Inventors: Edward R. Lintott; Kenneth M. Harris, both of London, England

[73] Assignee: Lucas Industries Public Limited Company, Birmingham, England

[21] Appl. No.: 670,025

[22] Filed: Nov. 9, 1984

[30] Foreign Application Priority Data

Nov. 23, 1983 [GB] United Kingdom ..... 8331246

[51] Int. Cl.[4] ..... F02M 39/00

[52] U.S. Cl. ..... 123/458; 123/459; 123/506

[58] Field of Search ..... 123/506, 458, 459, 460, 123/446, 447

[56] References Cited

U.S. PATENT DOCUMENTS

| | | | |
|---|---|---|---|
| 3,638,629 | 2/1972 | Moon | 123/506 |
| 4,450,783 | 5/1984 | Morris et al. | 123/458 |
| 4,474,158 | 10/1984 | Mowbray | 123/506 |
| 4,502,445 | 3/1985 | Roca Nierga et al. | 123/458 |

FOREIGN PATENT DOCUMENTS

| | | | |
|---|---|---|---|
| 128460 | 8/1983 | Japan | 123/506 |

*Primary Examiner*—Magdalen Y. C. Moy

[57] ABSTRACT

A liquid fuel injection pumping apparatus for supplying fuel to an internal combustion engine includes, a high pressure injection pump, an electrically operated spill valve which when open during a delivery stroke of the injection pump allows fuel to flow to a drain. The apparatus includes a control valve operable to control fuel flow through passage means to the injection pump, the control valve having three positions in the first of which there is unrestricted flow of fuel, in the second of which there is restricted fuel flow and in the third of which fuel flow is prevented. An angularly movable shaft is provided to close the spill valve and the control valve is connected to a shaft. The shafts exterior of the apparatus are connected to mechanisms whereby when the control valve is moved from the first position to the second position the spill valve will be closed thereby to allow the apparatus to supply fuel at a restricted rate.

6 Claims, 6 Drawing Figures

LIQUID FUEL INJECTION PUMPING APPARATUS

This invention relates to a liquid fuel injection pumping apparatus for supplying fuel to an internal combustion engine, the apparatus being of the kind comprising a high pressure reciprocable plunger fuel injection pump having an outlet connected in use, to an injection nozzle of an associated engine, a low pressure supply pump for supplying fuel under pressure to the high pressure pump during the filling periods thereof, passage means connecting the supply pump to an inlet of the high pressure pump, and an electrically controlled spill valve operable to divert fuel at high pressure from the high pressure pump thereby to control the amount of fuel supplied through said outlet.

The use of an electrically controlled spill valve enables very accurate control of the amount of fuel supplied to the associated engine to be effected. The valve in most cases will be electromagnetically operated and controlled by an electronic control system. It is arranged that in the event of an electrical failure, the spill valve will move to the open position, thereby preventing the supply of fuel to the associated engine. It is desirable to provide some arrangement whereby fuel can be supplied to the engine to enable the engine to be started and run at limited power in order, for example, to permit a vehicle driven by the engine to be moved to a safe place.

It is an object of the present invention to provide an apparatus of the aforesaid kind, in which this desideratum can be achieved.

According to the invention, in an apparatus of the kind specified, said passage means includes a valve operable to provide a variable restriction to fuel flow through said passage means and mechanically operated means operable in conjunction with said valve to close said spill valve.

An example of a fuel injection pumping apparatus in accordance with the invention will now be described with reference to the accompanying drawings in which.

Figures 1, 2, 3:
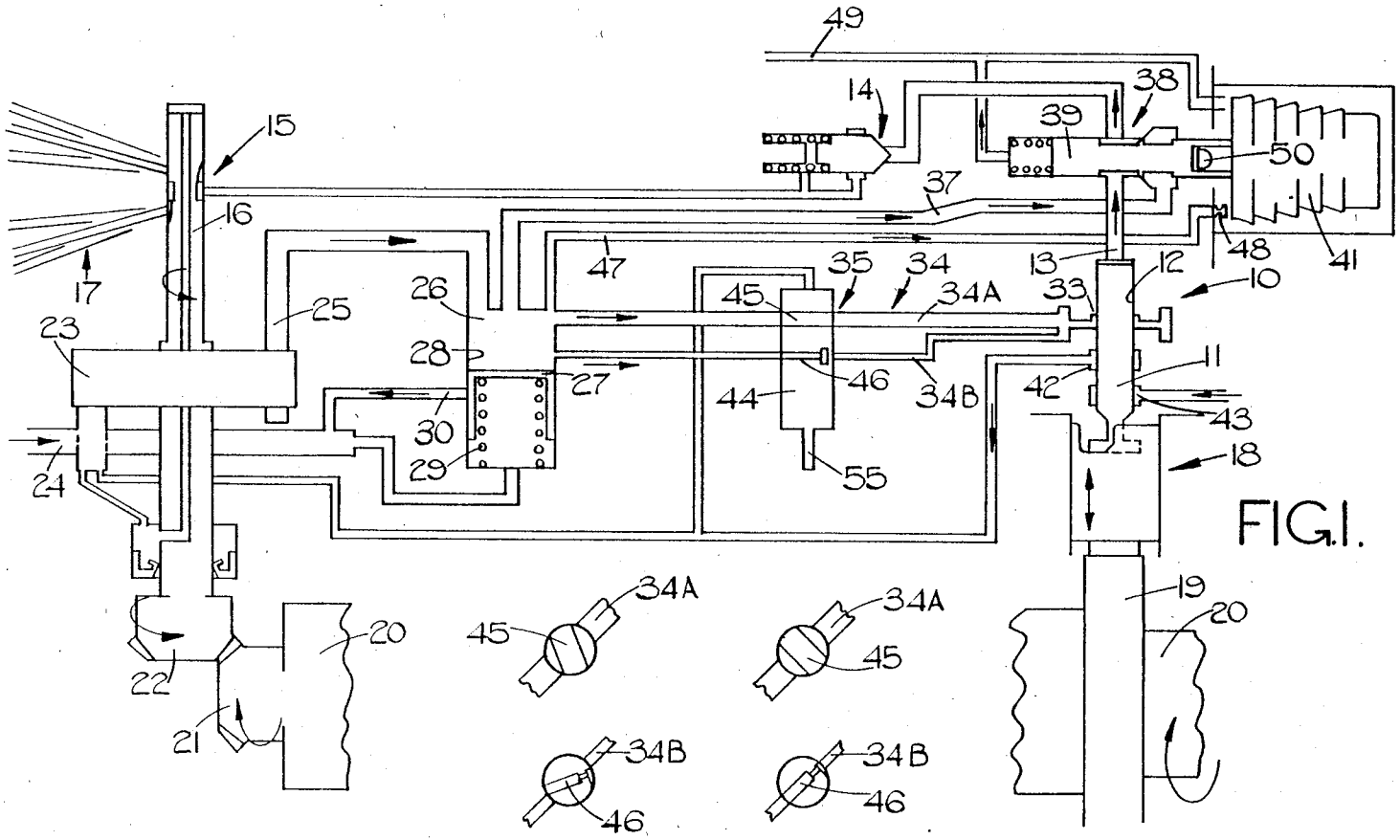
FIG. 1 is a diagrammatic representation of the apparatus.
FIGS. 2 and 3 show different settings of a part which is shown in a first setting in FIG. 1.

Referring to the drawings, the apparatus comprises a high pressure fuel injection pump generally indicated at 10 and including plunger 11 reciprocable in a bore 12 which has an outlet passage 13 connected by way of a spring loaded delivery valve 14 to a fuel distributor generally indicated at 15 and which includes a rotary distributor member 16. The distributor distributes fuel delivered during successive inward movements of the pumping plunger, to a number of outlets 17 in turn, the outlets being connected to the fuel injection nozzles respectively of the associated engine. The distributor member has a pair of oppositely directed longitudinal grooves connected to a circumferential groove the latter being connected by way of the delivery valve 14, to the outlet passage 13.

The plunger 11 is connected to a tappet mechanism indicated at 18, and is driven upwardly by means of a cam 19 mounted upon a drive shaft 20 and is driven downwardly by a lever and further tappet mechanism (not shown) which is also actuated by the cam. The drive shaft also carries a bevel gear 21 with which meshes a further bevel gear 22 coupled to the distributor member 16. The drive shaft is driven in timed relationship with the associated engine. The shaft, of which the distributor member 16 forms part, carries the rotor generally indicated at 23, of a low pressure fuel supply pump having an inlet 24 and an outlet 25. The inlet in use, is connected to a source of fuel and the outlet 25 is connected to a fuel reservoir generally indicated at 26. The fuel reservoir comprises a piston 27 which is slidable mounted within a cylinder 28 and the piston is biased towards one end of the cylinder by means of a coiled compression spring 29. Formed in the wall of the cylinder is a port 30 which is uncovered by the piston when the latter has moved a predetermined distance against the action of the spring 29. The port 30 communicates with the inlet 24 of the low pressure pump and the piston acts to control the output pressure of the pump. The end of the cylinder 28 containing the spring 29 also communicates with the inlet 24.

Formed in the wall of the bore 12 which contains the plunger 11 is a circumferential groove 33 and this constitutes a fuel inlet for the high pressure pump.

The groove 33 communicates by way of passage means 34 with the reservoir 26 and a valve 35 to be described, controls flow of fuel through the passage means 34. The reservoir also communicates by way of a passage 37, with a spill valve which is generally indicated at 38. The spill valve includes a spring loaded valve member 39 which is shaped to co-operate with a seating. The valve member is spring biased to the open position and is urged into contact with the seating when a solenoid device 41 associated with the valve 38, is energised. When the solenoid device is de-energised, the spring urges the valve member out of sealing engagement with the seating and this will allow fuel to flow from the passage 13 to the passage 37.

The plunger 11 when at its maximum outward or downward position, as determined by the cam 19, uncovers the circumferential groove 33 to the pumping chamber which is defined by the bore 12 and the plunger. Assuming for the moment that the valve 35 is open and that the plunger is at the outermost limit of its stroke with the pumping chamber full of fuel. As the drive shaft 20 rotates inward movement will be imparted to the plunger 11 and the groove 33 will be covered by the end of the plunger. The fuel in the pumping chamber is now displaced along the passage 13 and if the spill valve 38 is in the closed position, the fuel will be displaced past the delivery valve 14 to an outlet 17. If during this displacement of fuel or before displacement commences, the spill valve is opened, the fuel will be returned by way of the passage 37 to the reservoir 26. As a result no fuel will flow to the outlet 17. The maximum amount of fuel which can be supplied is determined by the stroke of the plunger which occurs after the end of the plunger has covered the groove 33. The spill valve can be operated at any time to determine the timing of fuel delivery and the quantity of fuel delivered. A leakage groove 42 is provided in the bore 12 and is connected to the fuel inlet 24 and a further groove 43 is provided which is connected to a source of lubricant.

The outward movement of the plunger is effected by the aforesaid further tappet mechanism and if the spill valve 38 remains in the open position fuel can flow into the bore 12 by way of the spill valve from the passage 37. Some fuel will flow into the bore when the groove 33 is uncovered by the plunger and if the spill valve is closed during the downward movement of the plunger all the fuel will flow into the bore by way of the groove 33.

In the event of failure of the control system which powers the solenoid device 41 and/or the device itself, the spill valve will move to the open position under the action of its spring and thereby no fuel can be supplied to the associated engine. The engine therefore is protected because if in the event of failure the spill valve remained in the closed position, the maximum amount of fuel would be supplied to the engine which could lead to overspeeding of the engine, possibly resulting in damage thereto.

In order to enable a limited quantity of fuel to be supplied to the engine in an emergency, the aforementioned valve 35 is provided. The valve 35 as previously mentioned, controls fuel flow through the passage means 34 which in fact comprises two passages 34A and 34B. Passage 34A is of substantial size to avoid any restriction to the flow of fuel to the bore 12 during normal operation of the apparatus. The valve 35 includes an angularly movable valve member 44 in which is formed a drilling 45 having a size to connect the two parts of the passage 34A without imposing restriction, when the valve member is in a first position. The passage 34B is of reduced size and may in itself impose some restriction to the flow of fuel. The valve member 44 has a drilling 46 which in a second position of the valve member as shown in FIG. 2, connects the two parts of the passage 34B. The drilling 46 is constructed to form a restrictor which provides a restriction to the flow of fuel and in addition, the opening of the drilling onto the periphery of the valve member communicates with a flat on the valve member whereby variable restriction to fuel flow can be obtained by movement of the valve member to the second position. In a third position of the valve member which is shown in FIG. 3 and which lies between the first and second positions, both drillings are out of register with their respective passages and so no fuel can take place to the injection pump through the passages.

In the situation where failure of the control system and/or the solenoid device 41 has taken place, the valve 35 is moved to the second position. This will enable a limited flow of fuel to take place to the bore 12. However, the spill valve 38 must be closed otherwise the bore during downward movement of the plunger will be filled with fuel but what is more important, during upward movement of the plunger all the fuel would be returned to the reservoir. A mechanical linkage is therefore provided between the valve 35 and the spill valve 38 to ensure that when the valve 35 is moved to its second position, the spill valve is moved to its closed position. With the spill valve closed the flow of fuel to the pumping chamber of the high pressure pump takes place by way of the passage 34B and is restricted so that the delivery of the high pressure pump will be restricted. The size of the restrictor in the drilling 46 will determine the maximum power which can be developed by the engine. The arrangement will however permit the engine to be started but its power output will be strictly controlled by the throttling action.

The valve 35 can be moved to the third position as shown in FIG. 3 for the purpose of providing an emergency stop, such for example as may be required in the unlikely event that in the normal use of the apparatus, the valve member of the spill valve sticks in the closed position. As will be seen from FIG. 3 the passages 34A and 34B are closed so that while no spillage of fuel from the outlet 13 of the high pressure pump can take place, neither is any fuel supplied to the pump so that the supply of fuel to the engine must cease.

Various other passages are shown in FIG. 1 of the drawings, one such passage being indicated at 47, this passage providing a flow of fuel from the reservoir 26 for the purpose of cooling the solenoid device 41. The passage 47 has a restrictor 48 at its point of entry into the device 41 to restrict the flow of fuel and the fuel leaving the solenoid device flows to a drain, conveniently the fuel supply tank, by way of an outlet passage 49.

Figure 4:
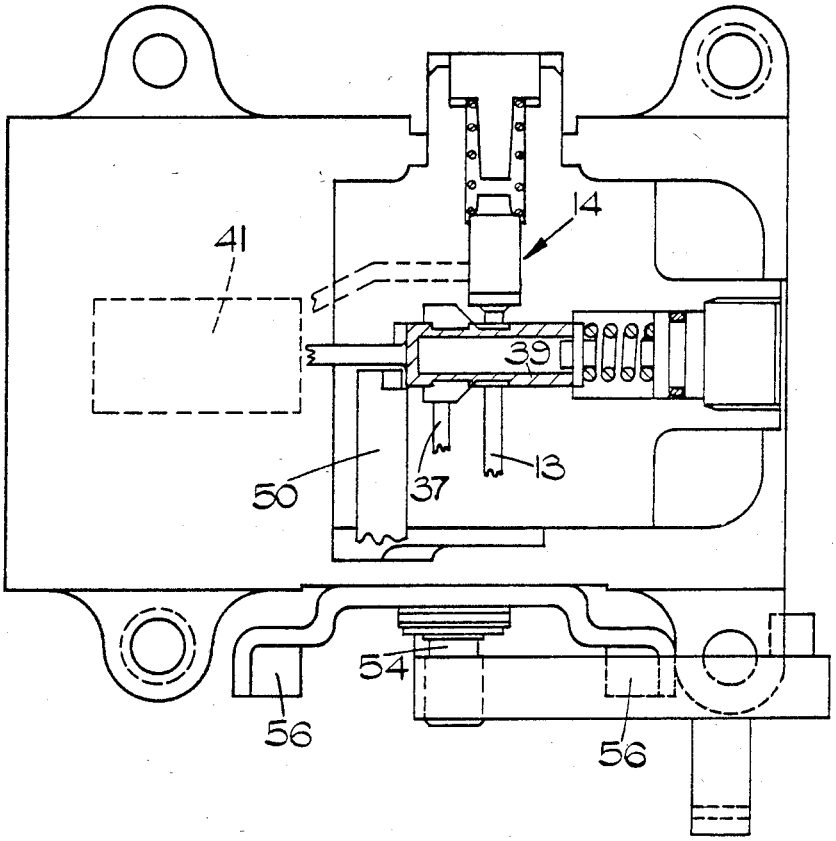
FIG. 4 is a sectional plan view of part of a practical version of the apparatus.
Figure 5:
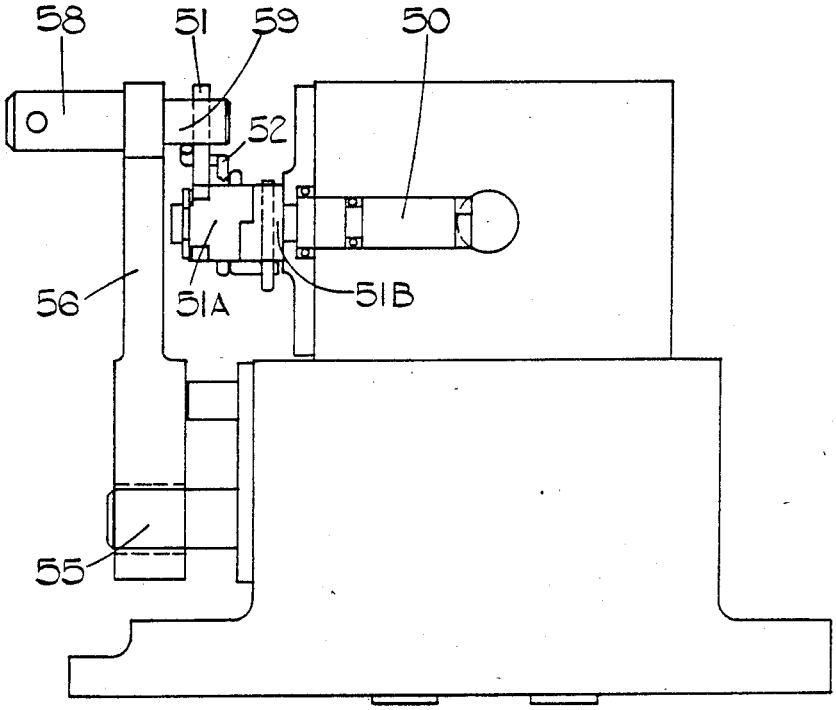
FIG. 5 is a sectional side elevation at right angles to FIG. 4.

The movement of the valve member 44 and the closure of the spill valve will now be described considering firstly the closure of the spill valve. The movement of the valve member 39 of the spill valve is achieved by means of a cam profile formed at the end of an angularly movable shaft 50 seen in FIG. 4. The end of the shaft 50 is also seen in FIG. 1 it being pointed out the disposition of the parts in FIG. 1 are reversed as compared with FIG. 4. The shaft 50 extends to the periphery of the housing of the apparatus and the extended portion carries a lever 51 extending from a bush 51A which is angularly movable on the shaft. Also mounted on the shaft is a further bush 51B which is secured to the shaft by a pin extending through the shaft. The bushes 51A and 51B have opposed interengaging portions which are biased into engagement with each other by means of a coiled spring 52 surrounding the bush 51A and having one end engaging with a projecting portion of the aforesaid pin. The bush 51A carries a projection 53 for engagement with a stop 54 the bushes, shaft, lever and projection being biased by a further spring the tail of which is seen at 53A, so that the projection 53 engages the stop 54. In this position the cam profile is clear of the valve member 39.

The valve member 44 of the valve 35 is also extended to define a shaft 55 extending onto the periphery of the housing. The shaft 55 carries a lever 56 the extent of movement of which is limited by a pair of stops 57. The lever carries an outwardly extending peg 58 for connection to an actuating cable and an inwardly extending peg 59 for engagement with the lever 51. The lever 56 will in normal operation of the apparatus be held in the position in which it is shown in full in FIG. 6 and in this position the drilling 45 in the valve member 44 will effect communication between the parts of the passages 34A.

Figure 6:
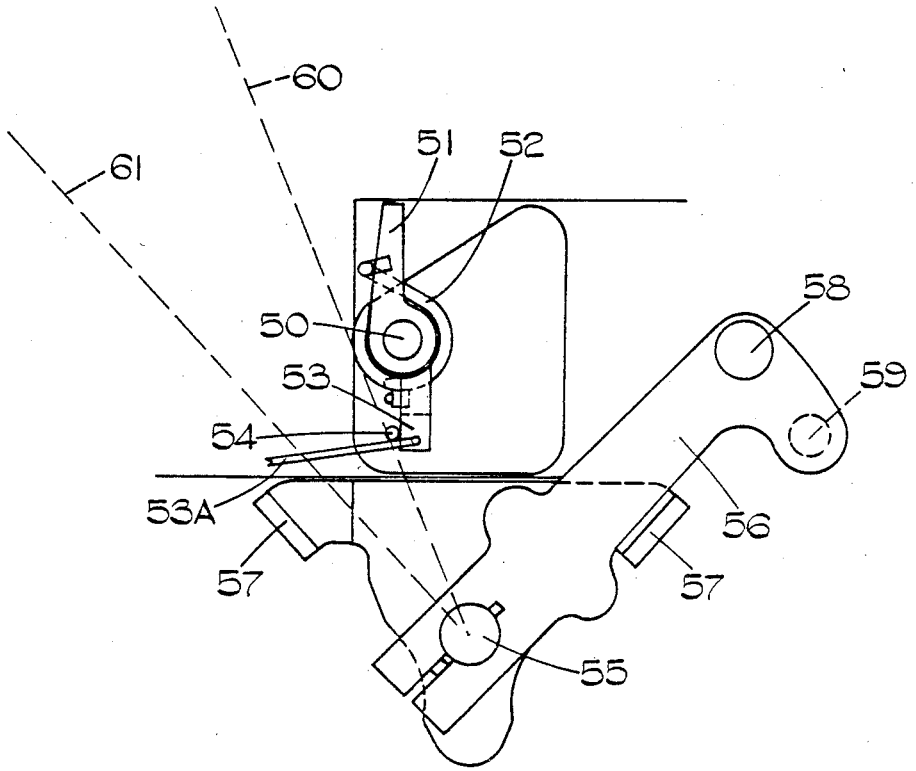
FIG. 6 is an exterior side view at right angles to FIG. 5.

When the lever 56 is moved in the anticlockwise direction to the position identified by the reference numeral 60 in FIG. 6, the valve member 44 assumes its third position as shown in FIG. 3. In this position fuel flow through the passages 34A and 34B is prevented and the associated engine will stop. It will be noted that as the lever 56 is moved to the aforementioned position the pin 59 engages with the lever 51 and starts to move the lever in the anticlockwise direction causing angular movement of the shaft 50. The cam profile on the shaft 50 has by the time the position 60 of the lever 56 is reached urged the valve member 39 of the spill valve into contact with the seating. Continued movement of the lever towards the limit stop 57 and the position shown at 61 effects continued movement of the lever 51 however, the spring 52 yields so that no further movement of the shaft 50 takes place after closure of the spill valve. The movement of the lever 56 however causes the valve member 44 to gradually open communication along the passage 34B until the maximum flow is achieved at position 61, the maximum flow being determined by the degree of restriction offered by the drilling 46.

When the lever is moved beyond the second position 60 the associated engine can be started and operated at low power to enable the vehicle driven by the engine to be moved. The actuating cable which is connected to the peg 58 is connected to a manually operable lever. As the lever 56 is moved between positions 60 and 61 an adjustable throttle action is obtained.

Since the levers 56 and 51 are on the exterior of the apparatus there is the possibility that they could be tampered with in particular, the lever 51 could be moved to close the spill valve 38 with the lever 56 in the normal run position. In order to prevent this a baulk mechanism (not shown) is provided to ensure that the lever 51 cannot be moved without movement of the lever 56.

We claim:

1. A liquid fuel injection pumping apparatus for supplying fuel to an internal combustion engine, the apparatus comprising a high pressure reciprocable plunger fuel injection pump having an outlet connected in use, to an injection nozzle of an associated engine, a low pressure supply pump for supplying fuel under pressure to the high pressure pump during the filling periods thereof, passage means connecting the supply pump to an inlet of the high pressure pump, an electrically controlled spill valve operable to divert fuel at high pressure from the high pressure pump thereby to control the amount of fuel supplied through said outlet, a valve in said passage means having a valve member, said valve being operable to provide a variable restriction to fuel flow through said passage means, and mechanically operated means operable in conjunction with said valve to close said spill valve, said passage means including first and second passages and the valve member of said valve being provided with corresponding drillings, the first passage and the respective drilling providing for substantially unrestricted flow of fuel to the high pressure pump in normal operation and in a first position of the valve, drillings in the valve being out of register with said passages in a second position of the valve, said second passage and the respective drilling providing for a variable but restricted flow of fuel when the valve is moved from the second position to a third position.

2. An apparatus according to claim 1, in which said valve is additionally operable to prevent flow of fuel through said passage means.

3. An apparatus according to claim 1 in which said third position of the valve fuel flow through said passage means is prevented.

4. An apparatus according to claim 3 in which said mechanically operable means includes an angularly movable first shaft, a cam profile formed on said shaft for engagement with said spill valve upon part rotation of said first shaft, a first lever mounted on said first shaft, a second shaft coupled to said valve in said passage means, a second lever mounted on said second shaft, a projection on said second lever for engagement with said first lever as the second lever is moved to move said valve from the first to the second position, whereby said spill valve will be closed when the valve in said passage means is at its second position.

5. An apparatus according to claim 4 including means connecting the first lever to the first shaft will allow continued movement of the first lever under the action of the second lever after said spill valve has closed.

6. An apparatus according to claim 5 including a baulk mechanism operable to prevent movement of said first lever in the direction to close said spill valve except under the action of said second lever.

* * * * *